United States Patent [19]

Gysling

[11] Patent Number: 4,566,684

[45] Date of Patent: Jan. 28, 1986

[54] AUTOMATIC SHEET FEED MECHANISM

[75] Inventor: Walter Gysling, Excelsior, Minn.

[73] Assignee: National Computer Systems, Edina, Minn.

[21] Appl. No.: 570,164

[22] Filed: Jan. 12, 1984

[51] Int. Cl.[4] ..... B65H 3/06

[52] U.S. Cl. ..... 271/117; 271/122; 271/127; 271/153

[58] Field of Search ..... 271/117, 118, 122, 127, 271/153, 154, 156

[56] References Cited

U.S. PATENT DOCUMENTS

| | | | |
|---|---|---|---|
| 1,627,064 | 5/1927 | Root | 271/156 |
| 2,992,820 | 7/1961 | Tarbuck | 271/153 X |
| 3,655,183 | 4/1972 | Wagner | 271/127 X |
| 4,268,027 | 5/1981 | Oleksiak | 271/153 |
| 4,273,323 | 6/1981 | Kaneko | 271/153 X |
| 4,461,466 | 7/1984 | Uchida | 271/117 X |

*Primary Examiner*—Richard A. Schacher

*Attorney, Agent, or Firm*—Merchant, Gould, Smith, Edell, Welter & Schmidt

[57] ABSTRACT

An automatic sheet feeding apparatus (20) for feeding sheets in a forward direction to a scanner device (22) or the like is disclosed. Sheet feeding apparatus (20) includes a frame including side plates (34, 36) a hopper table (40) pivotally mounted at a back edge, and transversely extending frame members (38). A lift mechanism (44) is interconnected to the hopper table (40) for raising the same. A pick roller (26) is utilized to advance the uppermost sheet of the stack of sheets (28) toward the scanner device (22). In addition, the pick roller (26) is operatively interconnected to the lift mechanism (44) to activate the lift mechanism (44) upon being lowered below a predetermined height such that the hopper table (40) is raised by the lift mechanism (44). Sheet separator rollers (30, 32) are positioned forwardly of the pick roller (26) for separating the uppermost sheet from any of the sheets inadvertently moved forwardly therewith. An integral drive mechanism (57) is provided for driving the pick roller (26), the sheet separator rollers (30, 32), and the lift mechanisms (44).

13 Claims, 10 Drawing Figures

FIG. 1
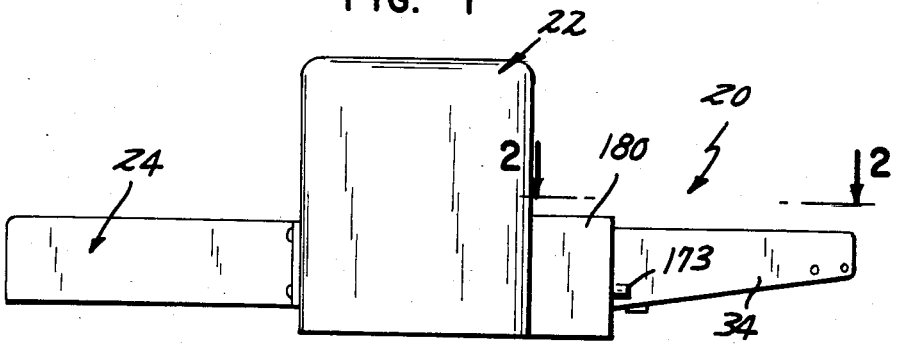
FIG. 9
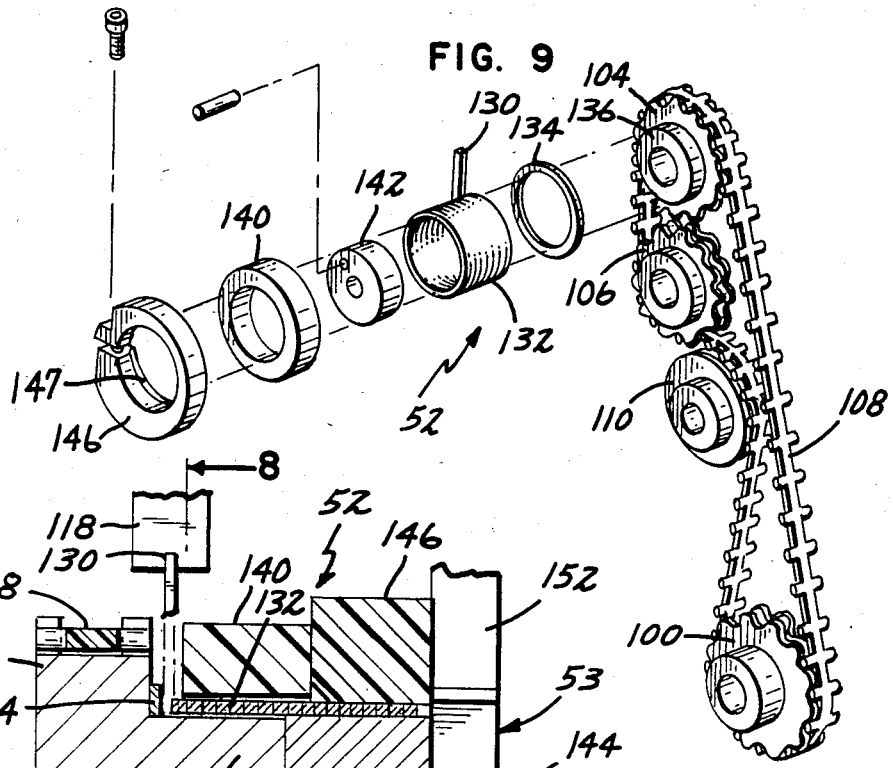
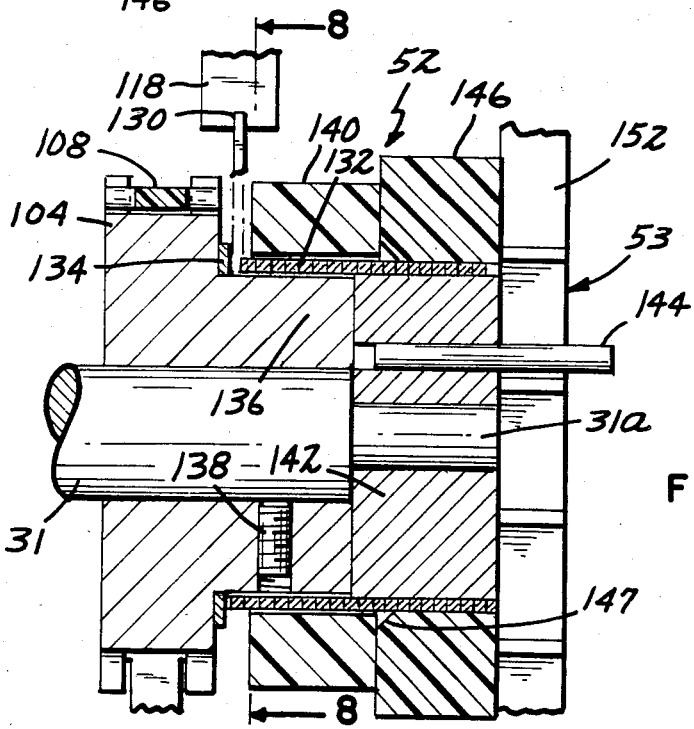
FIG. 7

AUTOMATIC SHEET FEED MECHANISM

BACKGROUND OF THE INVENTION

The present invention relates to an automatic sheet feed mechanism and more particularly to an automatic sheet feed mechanism using a pick roller apparatus for both advancing sheets and for sensing the height of a stack of sheets in its hopper.

Photocopiers and other devices such as automatic test scoring machines utilize automatic sheet feed mechanisms to provide a single sheet at the appropriate rate for operation on by the machine. Sheet feed mechanisms utilize a feeding mechanism for advancing the uppermost sheet of a stack of sheets to be operated on and a hopper table lift mechanism for raising the hopper table such that the stack of sheets are maintained at the proper height for operation on by the sheet feed mechanism. Typically, the sheet feed mechanism will include a pick roller for engaging the uppermost sheet and separator rollers for separating the uppermost sheet from any other sheet that might be inadvertently adhering thereto.

Automatic sheet feed mechanisms have long been used. However, many of these devices are rather intricate having many interacting parts. These devices are subject to frequent breakdown. Accordingly, the maintenance costs are quite high as well as their initial purchase cost. One factor which has contributed to this complexity is the use of a separate pick roller for advancing sheets and a sensor roller for sensing the top surface of the stack of sheets in the hopper. Furthermore, these devices frequently utilize a separate drive mechanism for feeding of the sheets and adjustment of the hopper table height which results in increased parts. Additionally, should some part become stuck or accidentally locked for whatever reason, the sheet feed mechanism is subject to substantial damage.

In addition, currently available automatic sheet feed mechanisms often have space requirements which are cumbersome and prohibitive to their use in certain applications.

These and many other problems are solved by the present invention.

SUMMARY OF THE PRESENT INVENTION

The present invention relates to an automatic sheet feeding apparatus for feeding sheets in a forward direction. The sheet feeding apparatus includes frame means for supporting a stack of sheets having a top surface and a bottom surface and including an uppermost sheet. The frame means includes a hopper table member, having a back edge and a front edge facing in the direction of sheet movement, for supporting the bottom surface of said stack of sheets during feeding thereof. The hopper table member is pivotally mounted proximate the back edge for pivotal movement about a horizontal axis. The sheet feeding apparatus further includes lift means interconnected to the hopper table for raising the front edge of the hopper table. Pick roller means is arranged for engaging the top surface of the stack of sheets to advance the uppermost sheet of the stack of sheets in the forward direction and for detecting when the top surface of the stack of sheets is below a predetermined height. The pick roller means is interconnected to the lift means to actuate the lift means whereby the hopper table is pivoted upwardly. The sheet feeding mechanism apparatus further includes sheet separating means for separating the uppermost sheet from any of the sheets inadvertently moved forwardly therewith. The sheet separating means includes first and second separating rollers positioned forwardly of the stack of sheets. Drive means is provided for driving the pick roller means, the first and second separating rollers, and the lift means.

The present invention provides an automatic sheet feed mechanism which requires few parts. Accordingly, purchase and maintenance costs are kept relatively low. In addition, there is less opportunity for the mechanism to jam or breakdown.

The pick roller apparatus of the present invention is utilized both to advance the uppermost sheet of the stack of sheets and for detecting when the top surface of the stack of sheets is below a predetermined height. Accordingly, a separate sensing mechanism is not required.

In one embodiment, an integrated drive is utilized to drive the pick roller apparatus, the sheet separator rollers, and the lift means. This results in a very economical use of parts and very limited space requirements.

Further, in a preferred embodiment, the lift mechanism for controlling the height of the hopper table includes a slip clutch which will allow a slipping action to occur should the table become stuck. Furthermore, the lift mechanism is utilized in conjunction with a friction clutch which results in incremental movement of the hopper table.

Also, an all mechanical, positive drive servo system is utilized to adjust the hopper table height in the preferred embodiment.

In the preferred embodiment, the sheet separator rollers rotate in the same direction such that the bottom roller serves to separate any sheets inadvertently adhering to the uppermost sheet as it is advanced forwardly between the sheet separator rollers.

In the preferred embodiment, the pick roller apparatus is raised and lowered under solenoid control.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter in which there is illustrated and described a preferred embodiment of the invention.

BRIEF DESCRIPTION OF THE DRAWINGS

In the drawings, in which like reference numerals and letters indicate corresponding parts throughout the several views, FIG. 1 is an elevational view of a scanner device utilizing an automatic sheet feed mechanism embodying the principles of the present invention;

FIG. 7 is an enlarged sectional view of an embodiment of the friction clutch mechanism utilized in the preferred embodiment of the present invention;

FIG. 9 is a perspective view of the drive mechanism illustrating the friction clutch mechanism in an exploded configuration.

DETAILED DESCRIPTION OF THE PREFERRED EMBODIMENT

Figure 2:
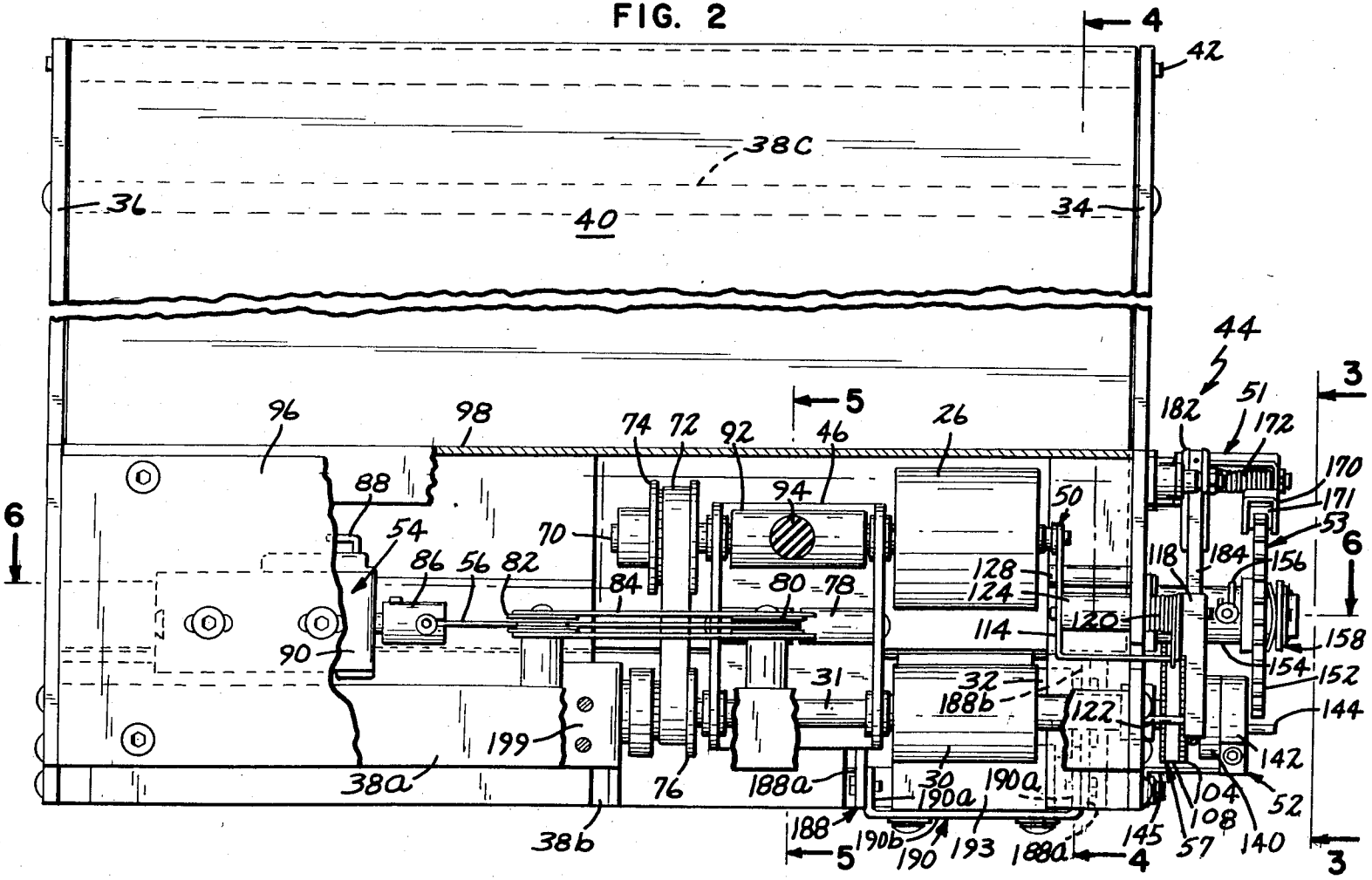
FIG. 2 is a top plan view with portions broken away of a preferred embodiment of the present invention as seen generally along line 2—2 of FIG. 1.

Referring now to FIG. 1, an embodiment of an automatic sheet feed mechanism, generally referenced by the reference numeral 20, is shown being used with a scanner device 22. In one application, the scanner device 22 might be utilized to score test papers which are automatically fed into the scanner device 22 by the sheet feed mechanism 20 under control of the scanner device 22. After being scored, the sheets are fed into an output bin 24. Illustrated in FIGS. 2 through 6 are features of the preferred embodiment of the sheet feed mechanism 20. As illustrated, the sheet feed mechanism 20 includes a pick roller 26 for engaging the uppermost sheet of a stack of sheets 28 and advancing the uppermost sheet of the stack in a forward direction toward the scanner 22. Two sheet separator rollers 30, 32 mounted on drive shafts 31, 33 respectively, are positioned forwardly of the pick roller 26 for separating from the uppermost sheet any sheets which are inadvertently adhering thereto. The frame of the sheet feed mechanism includes two spaced apart vertically extending side plates 34, 36 interconnected by a plurality of transversely extending elongated frame members 38. A hopper table 40 for supporting the stack of sheets 28 is pivotally mounted at the back or downstream edge thereof at 42 to the side plates 34, 36 for pivotal movement about a generally horizontal axis. One of the frame members 38*c* functions as a stabilizer bar for stabilizing the hopper table 40 near the back edge thereof. Interconnected to the hopper table 40 near the downstream or forward edge of the hopper table 40, is a mechanical servo arrangement or lift mechanism, generally designated by the reference numeral 44, for raising the hopper table 40 such that the top surface of the stack of sheets 28 generally remains above a predetermined height during the feeding process to assure proper feeding of sheets to the scanner device 22. The pick roller 26 is pivotally interconnected by a carriage 46 to the horizontally extending drive shaft 31 on which the sheet separator roller 30 is fixedly mounted for rotational movement. Accordingly, the pick roller 26 is mounted for pivotal movement about a generally horizontally extending axis and functions as a level sensor for sensing when the upper surface of the stack of sheets 28 is generally below a certain height. The pick roller 26 is interconnected by an actuator mechanism 50 to the lift mechanism 44 which includes a friction clutch 52, a lift wheel or geneva gear arrangement 53, and a ratchet lever assembly 51. The pick roller 26 is raised and lowered by a solenoid 54 which is interconnected to the carriage 46 by a cable 56. Upon being lowered beyond a predetermined height, the actuator mechanism 50 causes the friction clutch 52 to engage and interact with the lift wheel 53 whereupon the hopper table 40 is raised a predetermined distance for each revolution of the friction clutch 52. As illustrated in FIGS. 2 through 6 a DC motor 58 is utilized to provide an integral drive mechanism 57 for the sheet separator rollers 30, 32, the pick roller 26, and the lift mechanism 44. A switch actuator 60 is provided at the bottom of the hopper table 40 for detecting the presence of any sheets. The preferred embodiment of the present invention will hereafter be described in more detail.

The pick roller 26 is fixedly mounted to a rotatable shaft 70 for rotational movement therewith above the hopper table 40 proximate the forward or downstream end thereof. The shaft 70 is interconnected to the drive shaft 31 of the sheet separator roller 30 by a belt 72 and pulleys 74, 76. The pick roller carriage 46 has a generally U-shaped cross section and is positioned between the pulleys 74, 76 and the separator roller 30 and the pick roller 26 with the forward end being pivotally interconnected to the sheet separator roller shaft 31. A transversely extending bar member 78 is positioned between longitudinally extending sides of the carriage 46. The bar member 78 is interconnected near its mid section to the cable 56 so as to be interconnected to the solenoid 54. The cable 56 extends over a pulley 80 and under a pulley 82 which are rotatably mounted by a frame 84 to one of the transversely extending frame members 38*a*. The solenoid 54 includes an actuator 86 operatively interconnected to the solenoid 54 for movement along a generally horizontal axis. Accordingly, as the actuator 86 is pushed toward the pick roller carriage 46 the pick roller 26 is lowered and as the actuator 86 is pulled away from the carriage 46, the pick roller 26 and the carriage 46 are raised. Although not shown, it will be appreciated that the solenoid 54 is interconnected to the scanner device 22 by suitable electrical interconnects attached to contacts 88. The solenoid 54 is contained largely within a frame member 90 for mounting to the frame of the sheet feed mechanism. Although not shown, the solenoid 54 is spring biased into the raised position. Accordingly when the solenoid 54 is deactivated the pick roller 26 is raised. When energized or activated, the solenoid 54 will overcome the biasing effect of the spring and lower the pick roller 26.

Figure 5:
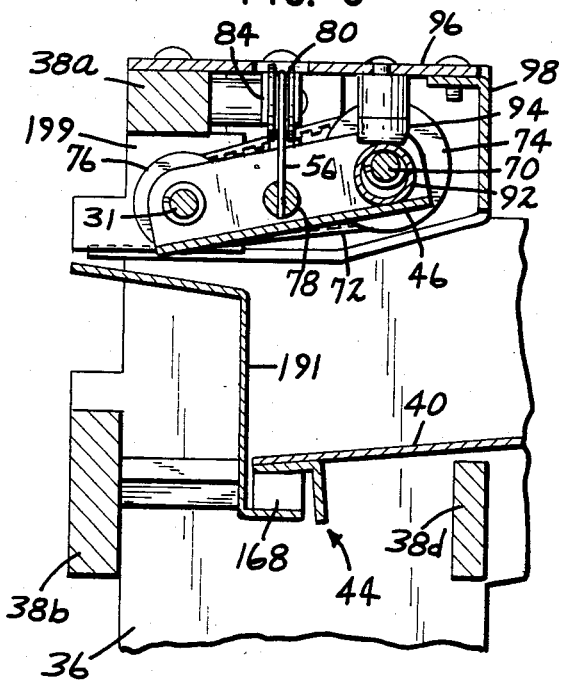
FIG. 5 is an enlarged partial view generally along line 5—5 in FIG. 2.

As illustrated in FIGS. 2 and 5, the shaft 70 on which the pick roller 26 is mounted includes a bearing member 92 mounted thereon between the sides of the carriage 46. The bearing member 92 interacts with a vertically extending stop member 94 which is attached to a ceiling plate 96 which extends between the sides 34, 36 and is interconnected to the frame member 38*a*. The bearing member 92 and the stop member 94 cooperate to provide for an upper stop of the vertical movement of the pick roller carriage 46. A deflector plate 98 interconnected to the ceiling plate 96 and extending transversely of the side plates 34, 36, generally encloses the back and bottom sides of the pick roller 26 and its associated parts. The deflector plate 98 defines an opening in its bottom surface to enable the pick roller 26 and its carriage to be lowered to the surface of the sheets.

Figure 3:
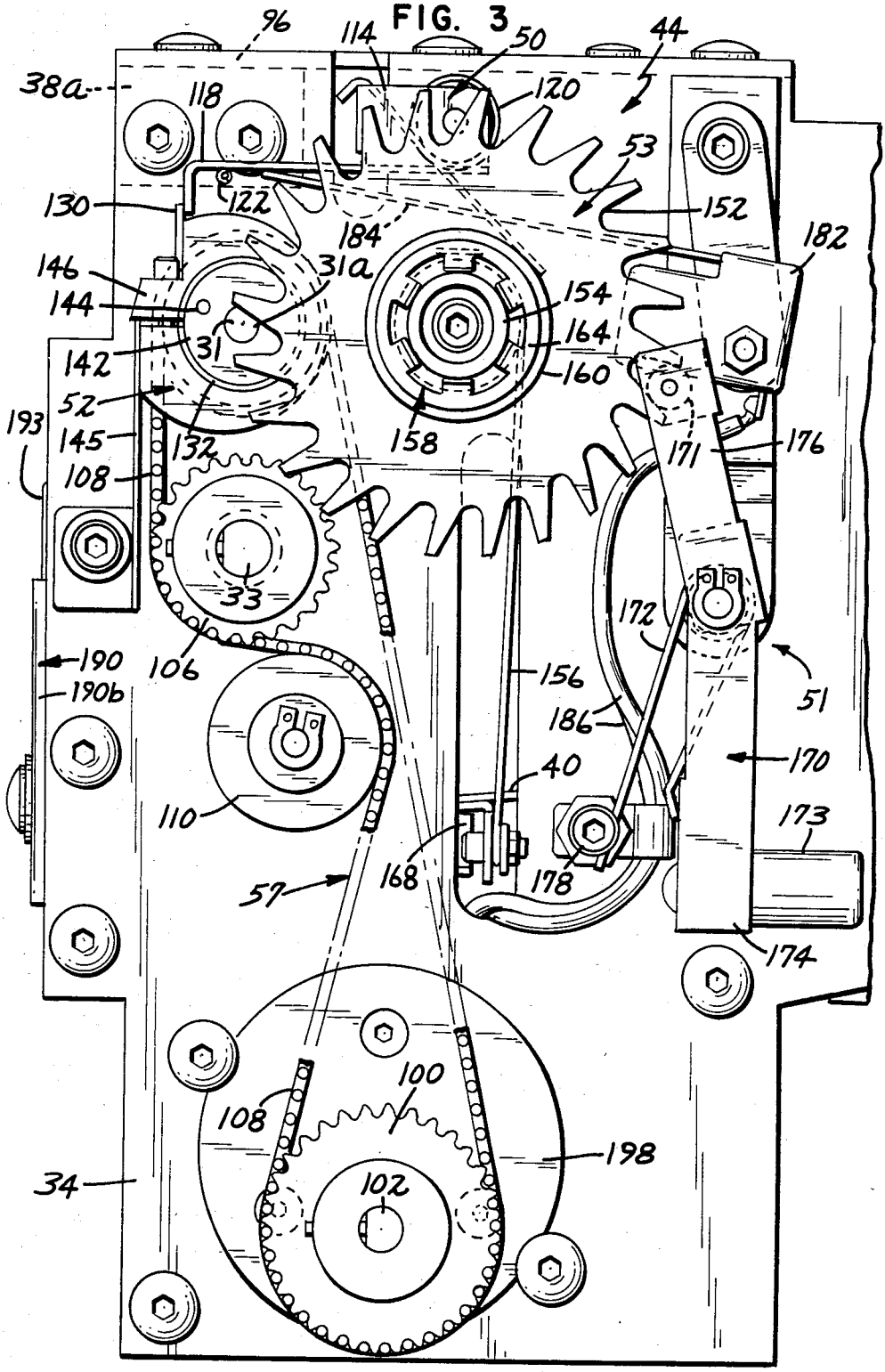
FIG. 3 is an enlarged partial side elevational view generally along the line 3—3 in FIG. 2.

The sheet separator rollers 30, 32 and the lift mechanism 44 are positively driven by the motor 58. As illustrated in FIGS. 3 and 9, a drive pulley 100 interconnected to the motor 58 by a drive shaft 102 is interconnected to pulleys 104, 106 of the sheet separator rollers 30, 32 by a synchronous, positive drive belt 108. An idler pulley 110 is also utilized in the pulley, drive belt arrangement. Accordingly, as the motor 58 drives the drive pulley 100 the pulleys 104, 106 are also so driven. In addition, the pick roller 26 which is interconnected to the drive shaft 31 of the sheet separator roller 30 is also driven by the motor 58. This significantly reduces the overall complexity and number of working elements in the system. Furthermore, proper timing and coordination between the elements is assured.

The actuator mechanism 50 for actuating the lift mechanism 44 includes an elongated trip link member 112 which slideably engages the end of the pick roller drive shaft 70. The trip link member 112 is pivotally mounted to a bracket 114 at 116. The bracket 114 is pivotally mounted to the side plate 34 for pivotal movement about a generally horizontal axis. The bracket 114 includes an elongated trip lever 118 extending toward the forward or downstream end of the sheet feed mechanism on the outside of the side plate 34. The actuator mechanism 50 further includes a coil spring 120 biasing the trip lever 118 in a downward direction, an outwardly projecting support member 122 preventing downward movement of the trip lever beyond a predetermined point. A spacer member 124 is positioned between the side plate 34 and the inside portion of the bracket 114 to maintain the proper spacing thereof. As the pick roller 26 is lowered, the end of the pick roller shaft 70 slides along an oval opening 126 defined in the trip link member 112. Upon reaching the bottom of the oval opening, the shaft 70 forces the trip link member 112 downward which causes the bracket 114 to pivot downward and the trip lever 118 to pivot upward such that the trip lever 118 does not engage the slip clutch 52. The downward movement of the actuator mechanism 50 is limited by an inwardly projecting support member 128. When the pick roller 26 is raised, the bracket 114 is pivoted upwardly due to the biasing affect of the coil spring 120 and the trip lever 118 is pivoted in a generally downward direction.

In the preferred embodiment, the friction clutch 52 utilized is a spring clutch. When the trip lever 118 is in its lowered position it engages a generally vertically extending end portion 130, also referred to as a spring release tang of a clutch spring 132 of the friction clutch 52, the friction clutch 52 being shown in greater detail in FIGS. 7 through 9. As illustrated in the exploded view in FIG. 9, the clutch spring 132 is a spring coil, the spring itself having a square cross section. The spring clutch 52 includes a spacer 134 which is mounted between the clutch spring 132 and the pulley 104 as generally illustrated in FIG. 7. As illustrated in FIG. 7, a portion of the clutch spring 132 is positioned over a hub portion 136 of the pulley 104. The pulley 104 is fixedly secured to the shaft 31 by an allen screw 138 or the like. Positioned about the outside circumference of the clutch spring 132 is a clutch spring sleeve 140. The sleeve 140 restricts the diameter of the spring 132 and facilitates in retaining any grease which might be placed over the spring 132. The shaft 31 includes a portion 31*a* of lesser diameter on which is mounted a cylindrical index drive member 142 including a dowel pin 144. Positioned about the outside of the index drive member 142 is an eccentric screw clamp 146 for clamping the outer portion of the clutch spring 132 to the index drive member 142. This maintains a fixed angular relation between the spring release tang 130 and the dowel pin 144 such that when the clutch spring 132 is stopped by the trip lever 118, the dowel pin 144 will not interfere with the geneva gear assembly 53. The screw clamp 146 defines a bevel 147 on the interior of the end facing the clutch spring 132. A pawl check member 145 prevents the screw clamp 146 from rotating in a backwards direction when the clutch spring 132 is stopped by the trip lever 118.

Figure 8:
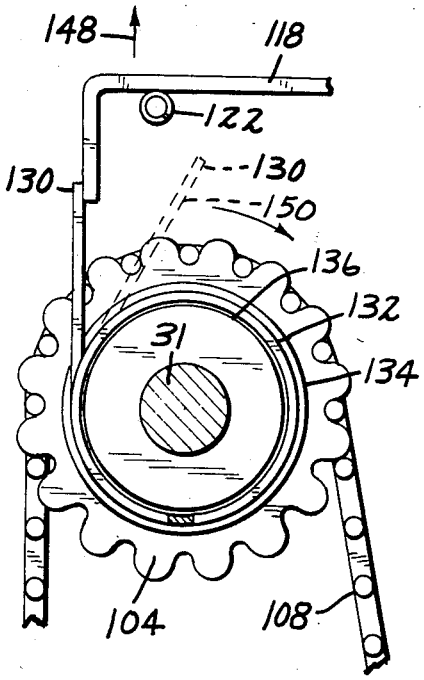
FIG. 8 is a view as seen generally along line 8—8 in FIG. 7 illustrating the clutch spring of the friction clutch of FIG. 7 in two differing positions.
Figure 6:
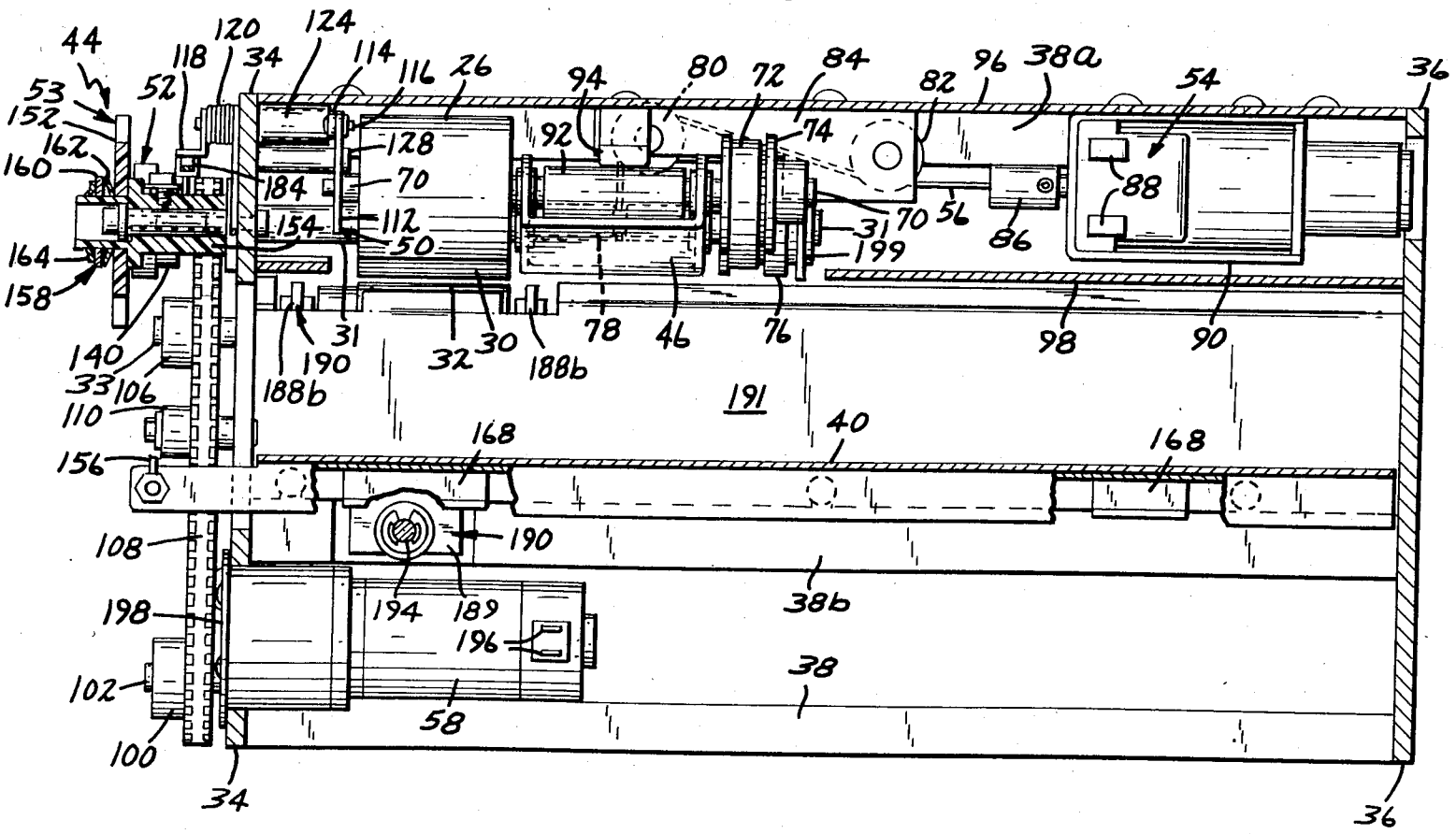
FIG. 6 is a sectional view generally along the line 6—6 in FIG. 2.

As illustrated in FIG. 8, when the trip lever 118 engages the clutch spring end portion 130, the clutch spring 132 is loosened about the hub portion 136 of the pulley 104 as illustrated in FIG. 8 by a solid line such that the pulley 104 is able to continue rotating while the dowel pin 144 remains stationary. Accordingly, the friction clutch 52 is effectively disengaged. When the trip lever 118 is raised as generally indicated by the arrow 148 in FIG. 8, the clutch spring end portion 130 moves forward generally into the position as indicated by the broken line 150 such that the clutch spring 132 is securedly grasping the hub portion 136 of the pulley. Accordingly, as the pulley 104 rotates, the clutch spring 132 and the dowel pin 144 rotates therewith. The trip lever is quickly returned to its lowered or disengaged positioned if the stack of sheets 28 is detected before the dowel pin makes one complete revolution. Accordingly, the clutch spring end portion 130 upon completion of a complete revolution will once again engage the trip lever 118. Accordingly, the friction clutch 52 once engaged, is allowed to complete one revolution if the stack of sheets is immediately detected upon movement of the hopper table 40 an incrememtal amount and therefore might be referred to as a single revolution clutch. In one application, the hopper table 40 is raised by an incremental amount which is approximately the thickness of fourteen sheets of paper. If the stack of sheets 28 is not detected, the friction clutch 52 remains engaged such that the dowel pin 144 will continue to rotate, periodically engaging the lift wheel mechanism 53 until the stack of sheets 28 is detected.

When the friction clutch is engaged, the dowel pin 144 engages one of the grooves defined by multiple serrations or teeth 153 of a drive wheel 152 of the lift wheel mechanism 53. The drive wheel 152 is interconnected to a hub 154 which is interconnected by a cable 156 to the hopper table 40. Accordingly, as the dowel pin 144 causes the drive wheel 152 to rotate, the cable 156 is wound up on the hub 154 thereby raising the hopper table 40. The drive wheel 152 axially retains the friction clutch 52 on the drive shaft 31.

In the preferred embodiment the drive wheel 152 is interconnected to the hub 154 by a slip clutch 158 such that should for some reason the hopper table 40 become jammed, the slip clutch 158 will enable the drive wheel 152 to continue rotating while the hub 154 remains stationary so as to prevent any damage to the lift or associated drive mechanism. In the preferred embodiment, the slip clutch 158 includes a clutch washer 160, a wave washer 162 and a retaining ring 164.

The ratchet lever assembly 51 is included for preventing the drive wheel 152 from slipping and for releasing the drive wheel 152, such that the hopper table 40 can be reset or lowered to its lowest or reset position whereupon the front edge of the hopper table rests on support pads 168. The ratchet lever assembly 51 indicates a ratchet lever 170 and a spring 172 for biasing the ratchet lever 170 into the drive wheel 152 such that an index roller 171 engages the teeth 153 of the drive wheel 152 and prevents the hopper table 40 from being lowered. Accordingly, the drive wheel 152 is allowed to rotate in only one direction unless the reset lever is activated by pushing in on a reset button 173 proximate a bottom portion 174 such that a top portion 176 thereof releases the drive wheel 152. A member 178 projecting outwardly from the side plate 34 limits the distance which the reset lever may be moved.

Accordingly an all mechanical lift mechanism is provided in the preferred embodiment as opposed to an electro-mechanical lift mechanism, thereby simplifying the lift mechanism and reducing space requirements. In the preferred embodiment, the drive mechanism 57, and the lift mechanism 44 are enclosed by a housing portion 180 as generally illustrated in FIG. 1.

In the preferred embodiment, a switch 182 is operatively interconnected by a contact member 184 to the trip lever 118. The member 184 is biased in upward direction such that when the pick roller 26 causes the trip lever 118 to be raised upon not detecting the stack of sheets, the member 184 is also raised activating the switch 182. When the switch 182 is activated, a signal is sent via appropriate electrical interconnects 186 to the scanner device 22 so as to inform the scanner device that the stack of sheets 28 has not been detected and no sheet is being forwarded thereto.

Figure 4:
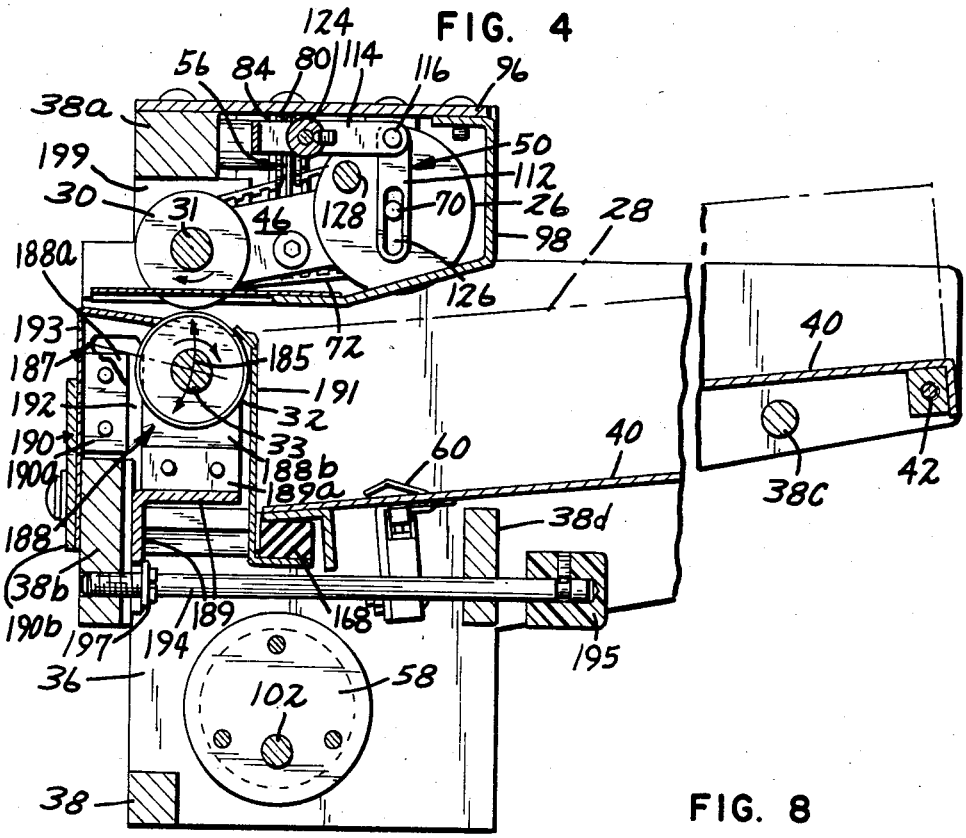
FIG. 4 is an enlarged fragmentary cross sectional view generally along the line 4—4 in FIG. 2.

In the preferred embodiment, as generally illustrated in FIG. 4, the sheet separator roller 32 which rotates in the same direction as the sheet separator roller 30 is adjustably mounted by a support frame assembly to enable the gap or separation between the rollers 30, 32 to be varied for different thicknesses of paper. The support frame assembly includes a bracket 190, the bracket 190 including a central portion **190*b* interconnecting two spaced apart flange portions 190*a*, fixedly mounted onto the frame member 38*b*. Attached to the flange portions 190*a* by suitable fasteners are two spaced apart vertically extending plates 188. The plates 188 each include a portion 188*a* attached to a respective flange portion 190*a* and a portion 188*b* separated by an L-shaped gap 192 from the portion 188*a*. The plates 188 are attached by suitable fasteners to vertically extending flange portions 189*a* of a right angle bracket 189 proximate the bottom of the portions 188*b*. An adjustment shaft 194, threadably interconnected to the transversely extending frame member 38*b* and slideably mounted in the frame member 38*d*, extends through a slot in the bracket 189. The adjustment shaft 194 includes a retaining ring and washer assembly 197 which engages the back side of the bracket 189. The portions 188*b* of the plates 188 are configured and arranged so as to be resiliently biased away from the portions 188*a* to provide the L-shaped gap 192 therebetween. By turning clockwise on a knob 195 of the adjustment shaft 194, the width of the L-shaped gap 192 can be varied by forcing forwardly on the bracket 189. Similarly the L-shaped gap 192 can be restored to its full width by turning the knob 195 counter clockwise. As the width of the L-shaped gap 192 is varied, the plate portion 188*b* pivots either upwardly or downwardly generally about location 187 at the end of the L-shaped gap 192. Accordingly, the sheet separator roller 32 moves upwardly or downwardly generally about the pivot point 187 generally along a circular arc as indicated by reference numeral 185. Thus the spacing between the sheet separator rollers 30, 32 can be adjusted for varying paper thicknesses by turning the knob 195. The plate portions 188*b* include suitable bearing assemblies for journaling the drive shaft 33 at its inner end and at a location intermediate its inner end and outer end. The outer end of the drive shaft 33 which is interconnected to the pulley 106 extends through an opening in the side plate 34 which is of larger diameter than the drive shaft so as to enable movement of the outer end of the drive shaft 33 as the sheet separator roller 32 is raised or lowered. The drive shaft 31 of the sheet separator roller 30 is fixedly mounted against vertical movement by a bracket 199 extending down from the frame member 38*a* which journals the inner end of the drive shaft 31 and the side plate 34 which journals the outer end of the drive shaft 31. An input ramp member 191 and an output ramp member 193 are positioned in back of and in front of the sheet separator roller 32 for guiding the sheets over the sheet separator roller 32**.

The motor 58 is preferably a DC 12 volt motor having a 60.5 to 1 ratio. The motor 58 is suitably interconnected at locations 196 to a suitable power supply. The motor 58 is mounted generally behind a drive plate 198 proximate the bottom of the side plate 34. In operation, the drive motor 58 drives via the drive belt 108 the sheet separator rollers 30, 32 and the hopper plate lift mechanism 44. Accordingly, an integral synchronous drive arrangement is provided thereby assuring proper timing and cooperation between the various working parts. Additionally, the drive mechanism is greatly simplified thereby reducing manufacturing and maintenance costs.

Figure 10:
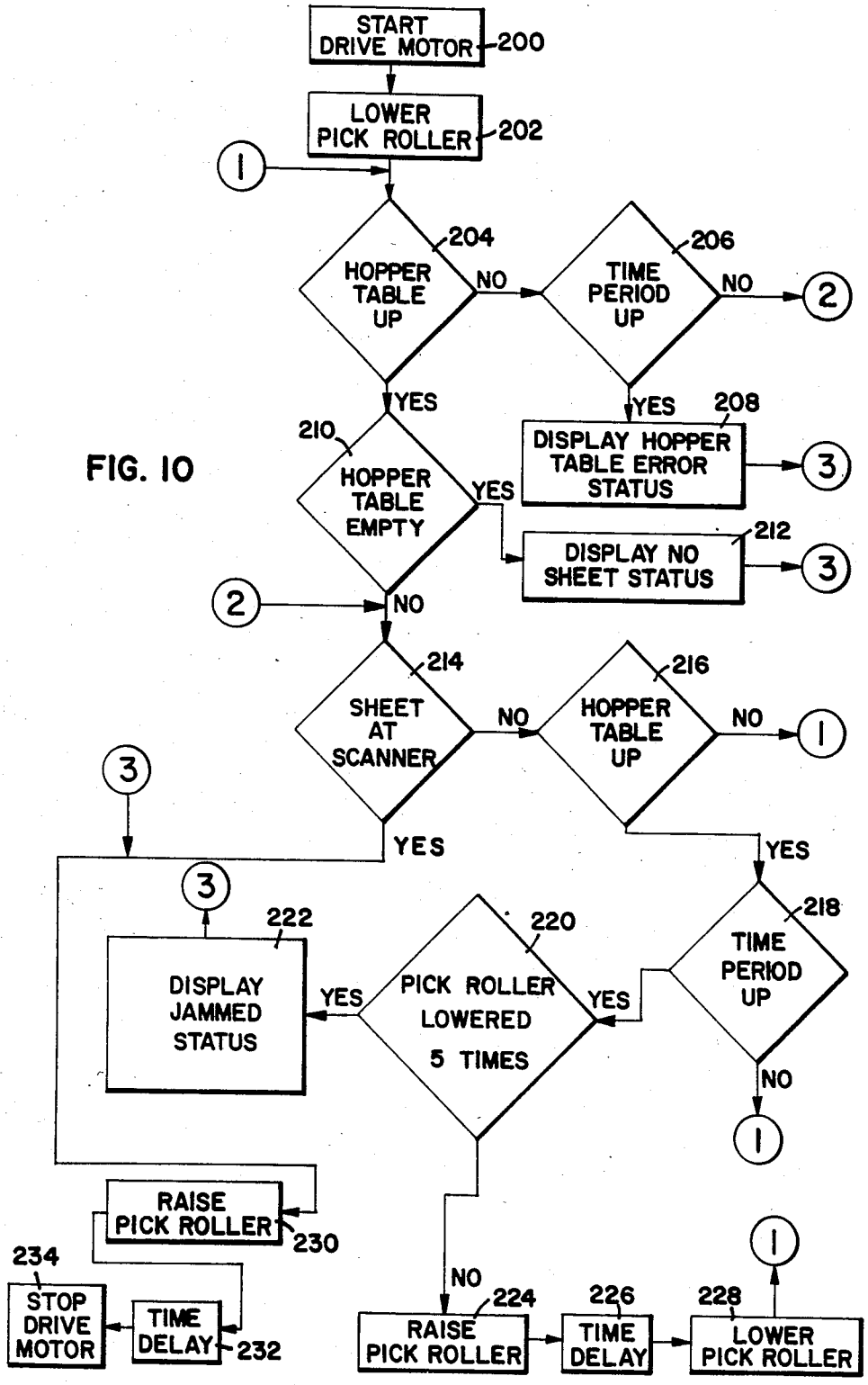
FIG. 10 is a block diagram of control logic in one embodiment of the present invention.

In the preferred embodiment of the present invention, it is anticipated that the scanner device 22 will include control logic as generally illustrated in FIG. 10 for controlling the automatic feed mechanism and a suitable sheet detection sensor (not shown) for detecting the presence of sheets at the scanner device 22. It will be appreciated that control of the automatic feed mechanism 20 might be implemented in various ways, FIG. 10 generally illustrating but one method by which control of the automatic feed mechanism 20 might be implemented. As illustrated at 200 and 202, the scanner device 22 will start the drive motor 58 and energize the solenoid 54 so as to lower the pick roller 26 when the scanner device 22 is initially started or during the sheet feeding process as the scanner device 22 requires another sheet to operate on. If at 204 after the pick roller 26 is lowered, the hopper table switch 182 transmits a signal to the control logic indicating the hopper table 40 is not in a raised position, then as illustrated at 206 a check will be made to ascertain whether a sufficient period of time has elapsed to enable the hopper table 40 to be raised from its lowest position to its highest possible position. This is done to assure that upon initially starting the scanner device 22 there is sufficient time provided to raise the hopper table to a sufficient operating height. In certain applications this time period will be a few seconds, a ten second time period being utilized in the perferred embodiment. If a sufficient time has elapsed to enable the hopper table 40 to be sufficiently raised such that the pick roller 46 should have detected the upper surface of the stack of sheets 28, then as indicated at 208 a hopper table error status is displayed at the scanner device indicating the hopper table 40 is not in a proper position. This might; for example, be caused by the hopper table 40 being jammed so as to not be capable of movement. If sufficient time has not elapsed to enable the hopper table 40 to be fully raised, then as indicated at 214 a check is made to ascertain whether the sheet detection sensor at the scanner device 22 has detected a sheet. This check is performed even though the hopper table is not fully raised as the uppermost sheet may have been inadvertently engaged by the pick roller 26 and advanced in the forward direction to the scanner device 22 even though the switch 182 indicates that the hopper table is not properly raised. This might occur if the pick roller just barely engages the uppermost sheet when it is fully lowered. If no sheet is detected at the scanner device 22, the control process proceeds through step 216 and back to step 204. If a sheet is detected at the scanner device 22 then as indicated at step 230, the pick roller 26 is raised by deactivating the solenoid 54. As indicated at 232 there is a time delay, typically a fraction of a second and approximately one quarter second in preferred embodiment of the present invention, prior to stopping the drive motor 58 at step 234. This is done to assure that the dowel pin 144 will have made a complete revolution prior to stopping the drive motor 58. Thus the dowel pin 144 will not be stopped after a partial revolution so as to interfere with the drive wheel 152 of the lift mechanism 44. In addition to other advantages, this assures that the hopper table 40 can always be reset by use of the reset button 173. When a problem with the hopper table 40 is detected at step 208; steps 230, 232, and 234 are next performed similar to that as when a sheet is detected by the scanner device 22. Once again, this is to assure that the dowel pin 144 has made a complete revolution before comming to rest.

If the pick roller 26 detects the upper surface of the stack of sheets 28 indicating the hopper table 40 is at a sufficient height for feeding of sheets, a check is made at 210 to ascertain whether the sheet detection switch 60 detects any sheets as being present in the hopper table 40. If no sheets are detected, a no sheet status or hopper table empty status is displayed at 212 indicating the hopper table 40 is empty. This check is performed after the hopper table 40 is raised as the weight of the sheets alone may not be sufficient to actuate the switch 60. The switch 60 is placed so as to be just slightly out of vertical alignment with pick roller 26. Accordingly, when the pick roller 26 engages the sheets the weight of the pick roller 26 on the sheets will activate the switch 60 if there are any sheets present, but the pick roller 26 alone will not activate the switch 60. If the hopper table 40 is determined to have sheets therein, a check is made at 214 to ascertain whether the scanner sheet sensor has detected a sheet. If a sheet has been advanced to the scanner device 22 and detected by the sheet detection sensor, the solenoid 54 is deactivated to raise the pick roller 26 and after a period of time the drive motor 58 will be stopped as illustrated in steps 230, 232, and 234. If a sheet has not been detected at scanner device 22, a check is made a 218 to ascertain if a predetermined time period, typically a few seconds and in one embodiment approximately two seconds, has elapsed. If not, the control logic will recycle checking for detection of a sheet at the scanner device 22. If after the fixed time period, no sheet has been detected, a check is made at 220 to ascertain whether the pick roller 26 has been lowered a number of consecutive times in an effort to feed a sheet through to the scanner device 22. In the preferred embodiment, the pick roller 26 will be lowered five consecutive times in an attempt to feed a sheet. If the pick roller 26 has not been lowered five times, the solenoid 54 is deactivated by the scanner device 54 to raise the pick roller 26 at 224. At 226, after a predetermined period of time, preferably one second in the preferred embodiment, the solenoid 54 is activated to lower the pick roller 26 at 228 and once again the control logic will recycle through to check to see if any sheets have been delivered to the scanner device 22. If the pick roller 26 has been lowered five times, a feed mechanism jammed status is displayed at 222 indicating that apparently the feed mechanism is jammed. As illustrated at steps 230, 232, and 234 the pick roller 26 is then raised and after a predetermined time delay the motor 58 is stopped.

Accordingly in operation, the scanner device 22, activates the feed mechanism and informs the solenoid 54 when to lower the pick roller 26 to advance the next sheet of paper into the scanner device. The sheet separator rollers 30, 32 positioned forwardly or downstream of the pick roller 26 both rotate clockwise to separate any sheets inadvertently adhering to the uppermost sheet. If upon being lowered, the pick roller 26 does not detect the upper surface of the stack of sheets 28, the actuator mechanism 50 to which the pick roller 26 is operatively interconnected will activate or enable engagement of the friction clutch 52. Consequently, the dowel pin 144 will engage the drive wheel 152 of the hopper table lift mehanism so at to cause an incremental movement thereof and correspondingly raise the hopper table 40. Upon detecting the stack of sheets the pick roller 26 will advance the uppermost sheet of the stack of sheets 28 with the rollers 30, 32 separating the uppermost sheets from any sheets inadvertently adding thereto. Upon detection of a sheet at the scanner, the scanner will deactivate the solenoid to raise the pick roller 26 and deactivate the feed mechanism. When the scanner is ready to process the next sheet, the feed mechanism is activated and the pick roller 26 is lowered by the solenoid 54 so as to advance the next uppermost sheet when so instructed by the scanner device 22. If the stack of sheets 28 is not detected indicating the hopper table 40 is not raised, the pick roller 26 will remain in a lowered position until the scanner device 22 detects the presence of a sheet and informs the solenoid 54 to raise the pick roller 26. As previously discussed, if the stack of sheets 28 is detected but the scanner device does not detect a sheet within a predetermined period of time, the solenoid 54 is informed to raise and lower the pick roller 26 a predetermined number of times. If no sheets are still detected at the scanner device 22, a jam condition is determined to exist and the sheet feed mechanism is disabled. The switch 60 will inform the scanner device 22 when there are no more sheets present in the hopper whereupon the pick roller 26 will be raised and the drive motor 58 will be shut off.

It is to be understood that even though numerous characteristics and advantages of the invention have been set forth in the foregoing description, together with details of the structure and function of the invention, the disclosure is illustrative only, and changes may be made in detail, especially matters of shape, size and arrangement of parts within the principles of the invention, full extent indicated by the broad general meaning of the terms in which the appended claims are expressed.

What is claimed is:

1. An automatic sheet feeding apparatus for feeding sheets in a forward direction; comprising:

(a) frame means for supporting a stack of sheets having a top surface and a bottom surface and including an uppermost sheet, said frame means including a hopper table member, having a back edge and a forward edge facing in the direction of sheet movement, for supporting said stack of sheets during feeding thereof, said hopper table member being pivotally mounted proximate said back edge for pivotal movement about a horizontal axis;

(b) mechanical lift means interconnected to said hopper table member for raising said front edge of said hopper table member whereby said hopper table member is pivoted about said horizontal axis;

(c) pick roller means arranged for engaging the top surface of said stack of sheets to advance the uppermost sheet of said stack of sheets in the forward direction and for detecting when the top surface of said stack of sheets is below a predetermined height, said pick roller means being interconnected to said lift means so as to mechanically actuate said lift means upon detecting the top surface of said stack of sheets as being below the predetermined height;

(d) means interconnected to said pick roller means for raising and lowering said pick roller means;

(e) sheet separating means for separating said uppermost sheet from any of said sheets inadvertently moved forwardly therewith, said sheet separating means including first and second separating rollers positioned forwardly of said stack of sheets and cooperating with one another; and (f) integral drive means comprising single drive motor means operatively interconnected to said pick roller means, said sheet separating means and said lift means for driving said pick roller means, said sheet separating means, and said lift means.

2. An apparatus in accordance with claim 1, wherein said first and second separating rollers have horizontal axes of rotation substantially parallel to one another, said axes of said separating rollers being vertically offset from one another, said separating rollers being caused to rotate in the same direction by said drive means.

3. An apparatus in accordance with claim 1, wherein said sheet feeding apparatus includes means for determining whether there are any sheets resting on said hopper table.

4. An apparatus in accordance with claim 1, wherein said pick roller means is interconnected to said means for raising and lowering said pick roller means by a cable and pulley arrangement.

5. An apparatus in accordance with claim 1, wherein said pick roller means is operatively interconnected to a friction clutch arrangement of said lift means, said friction clutch arrangement having an engaged state and a disengaged state, said friction clutch arrangement being operatively interconnected to said drive means to rotate in synchronism therewith when in said engaged state, said friction clutch effecting movement of said lift means when in said engaged state, whereby said hopper table member is raised.

6. An automatic sheet feeding apparatus for feeding sheets in a forward direction, comprising:

(a) frame means for supporting a stack of sheets having a top surface and a bottom surface and including an uppermost sheet, said frame means including a hopper table member, having a back edge and a forward edge facing in the direction of sheet movement, for supporting said stack of sheets during feeding thereof, said hopper table member being pivotally mounted proximate said back edge for pivotal movement about a horizontal axis;

(b) pick roller means arranged for engaging the top surface of said stack of sheets to advance the uppermost sheet of said stack of sheets in the forward direction;

(c) sheet separating means for separating said uppermost sheet from any of said sheets inadvertently moved forwardly therewith;

(d) drive means for driving said pick roller means and said sheet separating means;

(e) lift means interconnected to said hopper table for raising said hopper table, said lift means including:

(i) a friction clutch assembly operatively interconnected to said drive means, said friction clutch assembly having a disengaged state wherein said friction clutch assembly is stationary and an engaged state wherein said friction clutch assembly is synchronously driven with said sheet separating means by said drive means;

(ii) a geneva gear mechanism capable of movement in first or second directions and including a serrated drive wheel interconnected to said hopper table member, said friction clutch assembly effectuating movement of said geneva gear mechanism in said first direction when in said engaged state; and (iii) a release lever assembly operatively interconnected to said geneva gear mechanism and having first and second states, said release lever assembly preventing movement of said geneva gear mechanism in said second direction when in said first state, said release lever assembly being biased into said first state, said release lever assembly enabling movement of said geneva gear mechanism in said second direction when in said second state whereby the hopper table member is lowered;

(f) actuator means interconnected to said pick roller means for activating said lift means when said pick roller means is lowered a predetermined amount, said actuator means being operatively interconnected to said friction clutch assembly to cause said friction clutch assembly to enter said engaged state when said pick roller means is lowered below a predetermined height and causing said friction clutch assembly to enter said disengaged state when said pick roller means is raised above said predetermined height; and (g) means operatively interconnected to said pick roller means for raising and lowering said pick roller means.

7. An automatic sheet feeding assembly for feeding sheets in a forward direction to a device for operating thereon such as a scanner or the like, said sheet feeding assembly comprising:

(a) frame means for supporting a stack of sheets having a top surface and a bottom surface and including an uppermost sheet, said frame means including a hopper table member, having a back edge and a forward edge facing in the direction of sheet movement, for supporting said stack of sheets during feeding thereof;

(b) pick roller means arranged for engaging a top surface of said stack of sheets to advance the uppermost sheet of said stack of sheets in the forward direction;

(c) sheet separating means for separating said uppermost sheet from any sheets inadvertently advanced forwardly therewith, said sheet separating means including first and second separating rollers positioned forwardly of said stack of sheets;

(d) mechanical servo means for adjusting the height of said hopper table member, said mechanicalservo means being interconnected to said pick roller means by mechanical actuator means for activating said mechanical servo means upon said pick roller means being lowered below a predetermined height; and (e) an integral drive means for driving said sheet separating means, said pick roller means, and said mechanical servo means; and (f) control means for raising and lowering said pick roller means.

8. An assembly in accordance with claim 7, further including first switch means operatively interconnected to said pick roller means for informing said control means when the top surface of stack of sheets is below a predetermined height and second switch means for informing said control means when there are no more sheets present in said hopper table member.

9. An assembly in accordance with claim 8, wherein said control means is configured for raising said pick roller means from said lowered position when a sheet is detected as being forwarded to said sheet operating device.

10. An assembly in accordance with claim 9, wherein said control means is arranged to raise and subsequently lower the pick roller means after said pick roller means has been lowered a predetermined period of time and said first switch means does not indicate the top surface of the stack of sheets is below a predetermined height and said second switch indicates there are sheets in the feeding apparatus.

11. An automatic sheet feeding apparatus for feeding sheets in a forward direction; comprising:

(a) frame means for supporting a stack of sheets having a top surface and a bottom surface and including an uppermost sheet, said frame means including a hopper table member, having a back edge and a forward edge facing in the direction of sheet movement, for supporting said stack of sheets during feeding thereof, said hopper table member being pivotally mounted proximate said back edge for pivotal movement about a horizontal axis;

(b) lift means interconnected to said hopper table member for raising said front edge of said hopper table member whereby said hopper table member is pivoted about said horizontal axis; the lift means including:

(i) a friction clutch arrangement mounted to a drive shaft of said sheet separator rollers, said friction clutch arrangement having an engaged and a disengaged state, said friction clutch arrangement rotating with said drive shaft when in said engaged state;

(ii) a serrated index wheel member interconnected to a shaft by a slip clutch arrangement for rotation therewith in either first or second directions, said friction clutch arrangement including a portion for engaging said serrated index wheel member and causing movement of same in the first direction when said friction clutch arrangement is in said engaged state, said shaft of said index wheel being interconnected to said hopper table member so as to raise hopper table member when rotating in the first direction; and (iii) said index wheel member being operatively interconnected to a ratchet lever mechanism having first and second states, said ratchet lever mechanism being biased into said first state, said ratchet lever mechanism preventing said index wheel assembly from rotating in the second direction when in said first state, said ratchet lever mechanism enabling said index wheel to rotate in the second direction when in said second state, whereby said hopper table member is lowered;

(c) pick roller means arranged for engaging the top surface of said stack of sheets to advance the uppermost sheet of said stack of sheets in the forward direction and for detecting when the top surface of said stack of sheets is below a predetermined height, said pick roller means being interconnected to said lift means so as to actuate said lift means upon detecting the top surface of said stack of sheets as being below the predetermined height;

(d) means interconnected to said pick roller means for raising and lowering said pick roller means;

(e) sheet separating means for separating said uppermost sheet from any of said sheets inadvertently moved forwardly therewith, said sheet separating means including first and second separating rollers positioned forwardly of said stack of sheets and cooperating with one another; and (f) drive means for driving said pick roller means, said sheet separating means, and said lift means.

12. An automatic sheet feeding apparatus for feeding sheets in a forward direction; comprising:

(a) frame means for supporting a stack of sheets having a top surface and a bottom surface and including an uppermost sheet, said frame means including a hopper table member, having a back edge and a forward edge facing in the direction of sheet movement, for supporting said stack of sheets during feeding thereof, said hopper table member being pivotally mounted proximate said back edge for pivotal movement about a horizontal axis;

(b) mechanical lift means interconnected to said hopper table member for raising said front edge of said hopper table member whereby said hopper table member is pivoted about said horizontal axis;

(c) pick roller means arranged for engaging the top surface of said stack of sheets to advance the uppermost sheet of said stack of sheets in the forward direction and for detecting when the top surface of said stack of sheets is below a predetermined height, said pick roller means being interconnected to said lift means so as to mechanically actuate said lift means upon detecting the top surface of said stack of sheets as being below the predetermined height;

(d) means interconnected to said pick roller means for raising and lowering said pick roller means;

(e) sheet separating means for separating said uppermost sheet from any of said sheets inadvertently moved forwardly therewith, said sheet separating means including first and second separating rollers positioned forwardly of said stack of sheets and cooperating with one another;

(f) integral drive means comprising single drive motor means operatively interconnected to said pick roller means, said sheet separating means and said lift means for driving said pick roller means, said sheet separating means, and said lift means; and (g) the lift means including friction clutch means operatively interconnected to the pick roller means and having an engaged state and a disengaged state, the friction clutch means being operatively interconnected to the drive means when in said engaged state to effectuate operation of said lift means whereby said hopper table is raised when said friction clutch means is in the engaged state, said friction clutch means being placed in the engaged state when said lift means is mechanically actuated by the pick roller means, said friction clutch means remaining in the engaged state while the pick roller means detects the top surface of said stack of sheets as being below a predetermined height and then returning to the disengaged state.

13. An apparatus in accordance with claim 12, wherein said friction clutch means includes a coil spring.

* * * * *